US008162232B2

(12) United States Patent
Knoeppel et al.

(10) Patent No.: US 8,162,232 B2
(45) Date of Patent: Apr. 24, 2012

(54) WATER STORAGE DEVICE HAVING A POWERED ANODE

(75) Inventors: Ray Oliver Knoeppel, Hartland, WI (US); Thomas Gerard Van Sistine, Menomonee Falls, WI (US); Mark Allan Murphy, Nashville, TN (US)

(73) Assignee: AOS Holding Company, Wilmington, DE (US)

( * ) Notice: Subject to any disclaimer, the term of this patent is extended or adjusted under 35 U.S.C. 154(b) by 470 days.

(21) Appl. No.: 12/052,920

(22) Filed: Mar. 21, 2008

(65) Prior Publication Data

US 2008/0164334 A1 Jul. 10, 2008

Related U.S. Application Data

(62) Division of application No. 10/950,851, filed on Sep. 27, 2004, now Pat. No. 7,372,005.

(51) Int. Cl.
*F24H 1/00* (2006.01)
*H05B 1/02* (2006.01)

(52) U.S. Cl. ..... 237/8 R; 219/481; 219/497

(58) Field of Classification Search ..... 237/8 R; 219/497; 324/439; 392/311, 457; 122/4 A, 122/14.1, 13.01; *F24H 1/50*
See application file for complete search history.

(56) References Cited

U.S. PATENT DOCUMENTS 3,037,920 A * 6/1962 Vixler ..... 205/730
3,066,082 A 11/1962 Marsh et al.
3,132,082 A 5/1964 Overmyer
3,135,677 A 6/1964 Fischer
3,424,665 A 1/1969 Mathews
3,576,556 A 4/1971 Sellors, Jr.
3,644,074 A 2/1972 Cade
3,647,196 A 3/1972 Cotton
3,727,073 A 4/1973 Cade
3,745,231 A 7/1973 Eager, Jr. et al.
3,877,864 A 4/1975 Carlson
3,941,553 A 3/1976 Bedford
(Continued)

FOREIGN PATENT DOCUMENTS

DE 2605088 7/1977
(Continued)

OTHER PUBLICATIONS

Machine translation of DE 10145575 A1, Electrolux Haustechnik GMBH, published Apr. 3, 2003.*
(Continued)

*Primary Examiner* — Steven B McAllister
*Assistant Examiner* — Phillip E Decker
(74) *Attorney, Agent, or Firm* — Michael Best & Friedrich LLP

(57) ABSTRACT

A dry-fire protection system and method. The dry-fire protection system includes a tank, a heating element, a powered electrode, a sensor, and a microcircuit. The heating element and the powered electrode are positioned in the tank, the powered electrode being positioned above the heating element. The powered electrode includes an electrode wire and a connector having an electrical connector coupled to the electrode wire, but electrically isolated from the tank, and a fastener for coupling the powered electrode to the tank. The sensor detects an electrical characteristic of a circuit formed by the tank, the powered electrode, and water in the tank. The microcircuit determines if a possible dry-fire condition exists based on a signal received from the sensor.

10 Claims, 3 Drawing Sheets

U.S. PATENT DOCUMENTS 4,000,961 A 1/1977 Mandock
4,086,048 A 4/1978 Carlson
4,087,742 A 5/1978 Khoo
4,136,001 A 1/1979 Nozaki et al.
4,231,852 A 11/1980 Ruckert
4,255,647 A * 3/1981 Rickert et al. ..... 204/196.03
4,306,189 A * 12/1981 Nozaki ..... 324/425
4,311,576 A 1/1982 Toudo et al.
4,343,987 A * 8/1982 Schimbke et al. ..... 392/312
4,347,430 A 8/1982 Howard-Leicester et al.
4,395,224 A 7/1983 Cade
4,407,711 A 10/1983 Baboian et al.
4,409,080 A 10/1983 Slough
4,416,618 A 11/1983 Smith
4,434,039 A 2/1984 Baboian et al.
4,444,551 A 4/1984 Mueller et al.
4,453,499 A * 6/1984 Palmer ..... 122/379
4,457,692 A 7/1984 Erdman
4,518,345 A 5/1985 Mueller et al.
4,527,125 A 7/1985 Miyanaka et al.
4,531,375 A 7/1985 Zinsmeyer
4,589,843 A 5/1986 Smith
4,604,054 A 8/1986 Smith
4,638,789 A 1/1987 Ueki et al.
4,692,591 A 9/1987 Cooley et al.
4,737,102 A 4/1988 Jinno et al.
4,755,267 A 7/1988 Saunders
4,819,587 A 4/1989 Tsutsui et al.
4,922,861 A 5/1990 Tsutsui et al.
4,925,386 A 5/1990 Donnelly et al.
4,972,066 A 11/1990 Houle et al.
4,975,560 A 12/1990 Wardy et al.
4,978,292 A 12/1990 Donnelly et al.
4,986,468 A 1/1991 Deisinger
4,993,401 A 2/1991 Diekmann et al.
5,023,928 A 6/1991 Houlde et al.
5,024,596 A 6/1991 Smith
5,035,607 A 7/1991 Peterson
5,046,944 A 9/1991 Smith
5,053,978 A 10/1991 Solomon
5,056,712 A 10/1991 Enck
5,102,328 A 4/1992 Robinson
5,176,807 A 1/1993 Kumar
5,260,663 A 11/1993 Blades
5,287,060 A 2/1994 Reddy et al.
5,295,818 A 3/1994 Robinson
5,342,493 A 8/1994 Boiko
5,367,602 A * 11/1994 Stewart ..... 392/308
5,442,157 A * 8/1995 Jackson ..... 219/492
5,445,719 A 8/1995 Boiko
5,446,348 A 8/1995 Michalek et al.
5,504,430 A 4/1996 Andersson
5,549,469 A 8/1996 Wild et al.
5,660,328 A 8/1997 Momber
5,671,113 A * 9/1997 Knepler ..... 361/103
5,831,250 A 11/1998 Bradenbaugh
5,872,454 A 2/1999 West
5,949,960 A 9/1999 Hall
6,059,195 A 5/2000 Adams et al.
6,080,973 A 6/2000 Thweatt, Jr.
6,085,738 A 7/2000 Robinson et al.
6,129,284 A 10/2000 Adams et al.
6,350,967 B1 * 2/2002 Scott ..... 219/497
6,437,300 B1 * 8/2002 Katzman et al. ..... 219/497
6,455,820 B2 * 9/2002 Bradenbaugh ..... 219/481
6,478,947 B2 11/2002 Nagasaku et al.
6,506,295 B1 1/2003 Takahashi et al.
6,522,834 B1 2/2003 Herrick et al.
6,529,841 B2 3/2003 Cocking et al.
6,561,138 B2 5/2003 Kobayashi et al.
6,572,364 B2 6/2003 Kawauchi et al.
6,633,726 B2 * 10/2003 Bradenbaugh ..... 392/463
6,649,881 B2 * 11/2003 Scott et al. ..... 219/492
6,690,172 B2 2/2004 Higo
6,690,173 B2 2/2004 Blades
6,701,874 B1 3/2004 Schultz et al.
6,795,644 B2 9/2004 Bradenbaugh
6,862,165 B2 3/2005 Chian et al.
6,866,202 B2 3/2005 Sigafus et al.
6,871,014 B2 3/2005 Pierre
6,902,661 B2 6/2005 Thomas et al.
6,930,486 B2 8/2005 Muscarella et al.
6,942,482 B2 9/2005 Honda et al.
7,169,288 B2 1/2007 Drapeau
7,189,319 B2 3/2007 Al-Mahrous
7,209,651 B1 * 4/2007 Knoeppel et al. ..... 392/451
7,238,263 B2 7/2007 Howard, Jr. et al.
7,372,005 B2 5/2008 Knoeppel et al.
7,706,670 B2 * 4/2010 Knoeppel et al. ..... 392/451
8,068,727 B2 * 11/2011 Phillips et al. ..... 392/441
2001/0020615 A1 * 9/2001 Bradenbaugh ..... 219/497
2002/0125241 A1 * 9/2002 Scott et al. ..... 219/492
2003/0063901 A1 4/2003 Gu et al.
2003/0164708 A1 9/2003 Park et al.
2004/0161227 A1 * 8/2004 Baxter ..... 392/454
2005/0006251 A1 1/2005 Thomas, III et al.
2005/0159844 A1 7/2005 Sigafus et al.
2006/0083491 A1 4/2006 Knoeppel et al.
2006/0141409 A1 6/2006 Chian et al.
2006/0199122 A1 9/2006 Matteson et al.
2006/0275719 A1 12/2006 Hill et al.
2006/0275720 A1 12/2006 Hotton et al.
2007/0125764 A1 * 6/2007 Knoeppel et al. ..... 219/497
2008/0080844 A1 * 4/2008 Miller et al. ..... 392/498
2008/0302784 A1 12/2008 Knoeppel et al.
2009/0038944 A1 * 2/2009 Kruger ..... 204/555
2009/0056644 A1 3/2009 Phillips et al.
2009/0061367 A1 3/2009 Caves et al.
2009/0061368 A1 3/2009 Caves et al.
2010/0116812 A1 * 5/2010 Watson et al. ..... 219/481
2010/0122978 A1 * 5/2010 Oh et al. ..... 219/540

FOREIGN PATENT DOCUMENTS

DE 2916934 8/1980
DE 3532058 3/1987
DE 3916847 11/1990
DE 19609892 9/1997
DE 10145575 4/2003
EP 0018522 11/1980
EP 1426467 6/2004
EP 1640478 3/2006
EP 1813698 8/2007
GB 1423959 2/1976
JP 59035686 2/1984
JP 62228494 10/1987
JP 08176858 7/1996

OTHER PUBLICATIONS

DE 10145575, Electrolux Haustechnik GmbH, machine translation, Apr. 2003.*
Chinese Patent Office Action for Application No. 200510107086.9 dated Jun. 10, 2010 (4 pages) English translation only.
Chinese Patent Office Action for Application No. 200510107086.9 dated Jun. 5, 2009 (5 pages) with English translation.
Chinese Patent Office Action for Application No. 200510107086.9 dated Jul. 4, 2008 (13 pages) with English translation.
European Patent Office Action for Application No. 05255925.9 dated Feb. 6, 2006 (4 pages).
European Patent Office Action for Application No. 05255925.9 dated Oct. 10, 2006 (4 pages).
European Patent Office Action for Aplication No. 07007885.2 dated Jun. 22, 2007 (5 pages).
European Patent Office Action for Application No. 07007885.2 dated Jan. 24, 2008 (7 pages).
United States Patent Office Action for U.S. Appl. No. 10/950,851 dated Dec. 15, 2005 (15 pages).
United States Patent Office Action for U.S. Appl. No. 10/950,851 dated Jun. 2, 2006 (19 pages).
United States Patent Office Action for U.S. Appl. No. 10/950,851 dated Nov. 30, 2006 (17 pages).
United States Patent Office Action for U.S. Appl. No. 10/950,851 dated Feb. 26, 2007 (4 pages).
United States Patent Office Action for U.S. Appl. No. 10/950,851 dated Jul. 16, 2007 (24 pages).

United States Patent Office Action for U.S. Appl. No. 10/950,851 dated Oct. 18, 2007 (3 pages).
United States Patent Office Action for U.S. Appl. No. 12/052,895 dated Jun. 21, 2010 (17 pages).
United States Patent Office Action for U.S. Appl. No. 12/052,895 dated Nov. 9, 2010 (19 pages).
Chinese Patent Office Action for Application No. 201110133102.7 dated Dec. 20, 2011 (4 pages).
European Patent Office Notice of Opposition for Application No. 05255925.9 dated Feb. 2, 2012 (26 pages).

* cited by examiner

WATER STORAGE DEVICE HAVING A POWERED ANODE

RELATED APPLICATION

This application is a division of co-pending U.S. patent application Ser. No. 10/950,851 filed Sep. 27, 2004, the entire content of which is incorporated herein by reference.

BACKGROUND

The invention relates to a water storage device having a powered anode and a method of controlling the water storage device.

Powered anodes have been used in the water heater industry. To operate properly, a powered anode typically has to resolve two major concerns. First, the powered anode should provide enough protective current to protect exposed steel within the tank. The level of exposed steel will vary from tank to tank and will change during the lifetime of the tank. Second, the protective current resulting from the powered anode should be low enough to reduce the likelihood of excessive hydrogen.

There are at least two techniques currently available in the water heater industry for using a powered anode to protect a tank. One technique adjusts anode voltage levels based on the conductivity of the water. However, this technique does not measure the protection level of the tank and tanks with excessive exposed steel could be inadequately protected. The second technique periodically shuts off the current to the anode electrode and uses the electrode to "sense" the protection level of the tank. This technique adapts to the changing amount of exposed steel in the tank, but does not adapt to changing water conductivity levels. In addition, this technique can have problems in high conductivity waters since currently produced titanium electrodes with mixed metal oxide films have a tendency to drift in their reference voltage measurements in high conductivity water. It would be beneficial to have another alternative to the just-described techniques.

SUMMARY

In one embodiment, the invention provides a water heater including a tank to hold water, an inlet to introduce cold water into the tank, an outlet to remove hot water from the tank, a heating element (e.g., an electric resistance heating element or a gas burner), an electrode, and a control circuit. The control circuit includes a variable voltage supply, a voltage sensor, and a current sensor. The control circuit is configured to controllably apply a voltage to the electrode, determine a potential of the electrode relative to the tank when the voltage does not power the electrode, determine a current applied to the tank after the voltage powers the electrode, determine a conductivity state of the water in the tank based on the applied voltage and the current, and define the voltage applied to the electrode based on the conductivity state.

In another embodiment, the invention provides a method of controlling operation of a water storage device. The method includes the acts of applying a voltage to an electrode, ceasing the application of the applied voltage to the electrode, determining the potential of the electrode relative to the tank after the ceasing of the application of the applied voltage, determining a conductivity state of the water, defining a target potential for the electrode based on the conductivity state, and adjusting the applied voltage to have the electrode potential emulate the target potential.

In another embodiment, the invention provides another method of controlling operation of a water heater including a tank, a heating element, an electrode, and a sensor configured to detect an electrical characteristic of a circuit formed by the tank, the electrode, and water in the tank. The method includes the acts of applying a voltage to an electrode, acquiring a signal from the sensor having a relation to the applied voltage, determining whether the water heater is in a dry-fire state based on the acquired signal, and limiting activation of a heating element when the water heater is in a dry-fire state.

In another embodiment, the invention provides a method of preventing activation of a heating element when a dry-fire condition exists in a water heater. The water heater includes a tank, a heating element positioned in the tank, a powered electrode positioned in the tank, and a controller. The method includes the steps of applying an analog voltage to the powered electrode, detecting a current having a relationship to the analog voltage, determining if the detected current is below a threshold, and isolating the heating element from a power source when the detected current is below the threshold.

In another embodiment, the invention provides a dry-fire detection system for a water heater including a tank having a bottom, a heating element positioned in the tank, a powered electrode positioned above the heating element with respect to the bottom, a sensor, and a microcircuit. The powered electrode includes an electrode wire positioned substantially in the tank, a connector assembly having an electrical connector coupled to the electrode wire and electrically isolated from the tank, and a fastener coupling the powered electrode to the tank. The sensor is configured to detect an electrical characteristic of a circuit formed by the tank, the powered electrode, and water in the tank. The microcircuit is coupled to the sensor and receives a signal from the sensor. The microcircuit determines a possible dry-fire condition exists based on the signal.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected," "supported," and "coupled" are used broadly and encompass both direct and indirect mounting, connecting, supporting, and coupling. Further, "connected" and "coupled" are not restricted to physical or mechanical connections or couplings, and can include electrical connections or couplings, whether direct or indirect.

Figure 1:
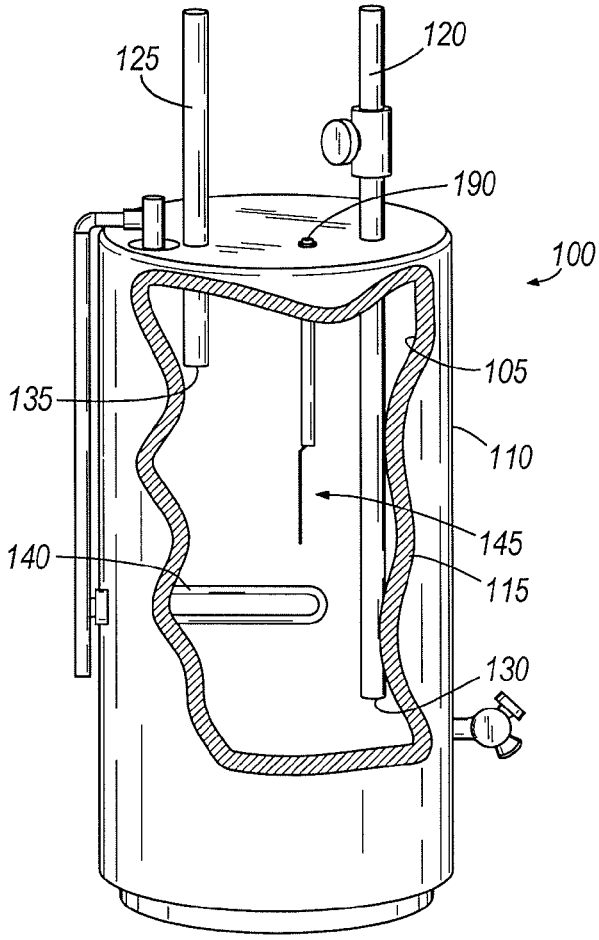
FIG. 1 is partial-exposed view of a water heater embodying the invention.

FIG. 1 illustrates a water heater 100 including an enclosed water tank 105, a shell 110 surrounding the water tank 105, and foam insulation 115 filling the annular space between the water tank 105 and the shell 110. A typical storage tank 105 is made of ferrous metal and lined internally with a glass-like porcelain enamel to protect the metal from corrosion. Nevertheless, the protective lining may have imperfections or, of necessity, may not entirely cover the ferrous metal interior. Under these circumstances, an electrolytic corrosion cell may be established as a result of dissolved solids in the stored water, leading to corrosion of the exposed ferrous metal and to reduction of service life for the water heater 100.

A water inlet line or dip tube 120 and a water outlet line 125 enter the top of the water tank 105. The water inlet line 120 has an inlet opening 130 for adding cold water to the water tank 105, and the water outlet line 125 has an outlet opening 135 for withdrawing hot water from the water tank 105. The water heater 100 also includes an electric resistance heating element 140 that is attached to the tank 105 and extends into the tank 105 to heat the water. The heating element 140 typically includes an internal high resistance heating element wire surrounded by a suitable insulating material and enclosed in a metal jacket. Electric power for the heating element 140 is typically supplied from a control circuit. While a water heater 100 having element 140 is shown, the invention can be used with other water heater types, such as a gas water heater, and with other water heater element designs. It is also envisioned that the invention or aspects of the invention can be used in other water storage devices.

Figure 2:
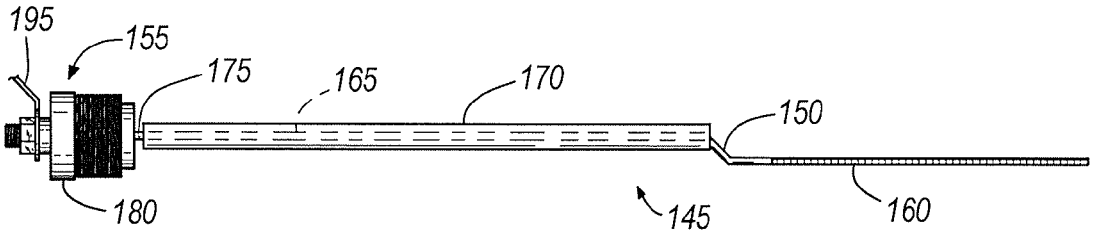
FIG. 2 is a side view of an electrode capable of being used in the water heater of FIG. 1.

An electrode assembly 145 is attached to the water heater 100 and extends into the tank 105 to provide corrosion protection to the tank. An example electrode assembly 145 capable of being used with the water heater is shown in FIG. 2. With reference to FIG. 2, the electrode assembly 145 includes an electrode wire 150 and a connector assembly 155. The electrode wire 150 comprises titanium and has a first portion 160 that is coated with a metal-oxide material and a second portion 165 that is not coated with the metal-oxide material. During manufacturing of the electrode assembly 145, a shield tube 170, comprising PEX or polysulfone, is placed over a portion of the electrode wire 150. The electrode wire 150 is then bent twice (e.g., at two forty-five degree angles) to hold the shield tube in place. A small portion 175 of the electrode wire 150 near the top of the tank is exposed to the tank for allowing hydrogen gas to exit the shield tube. In other constructions, the electrode assembly 145 does not include the shield tube 170. The connector assembly 155 includes a spud 180 having threads, which secure the electrode rod assembly to the top of the water tank 105 by mating with the threads of opening 190 (FIG. 1). Of course, other connector assemblies known to those skilled in the art can be used to secure the electrode assembly 145 to the tank 105. The connector assembly also includes a connector 195 for electrically connecting the electrode wire 150 to a control circuit (discussed below). Electrically connecting the electrode assembly 145 to the control circuit results in the electrode assembly 145 becoming a powered anode. As is known to those skilled in the art, the electrode wire 150 is electrically isolated from the tank 105 to allow for a potential to develop across the electrode wire 150 and the tank 105.

Figure 3:
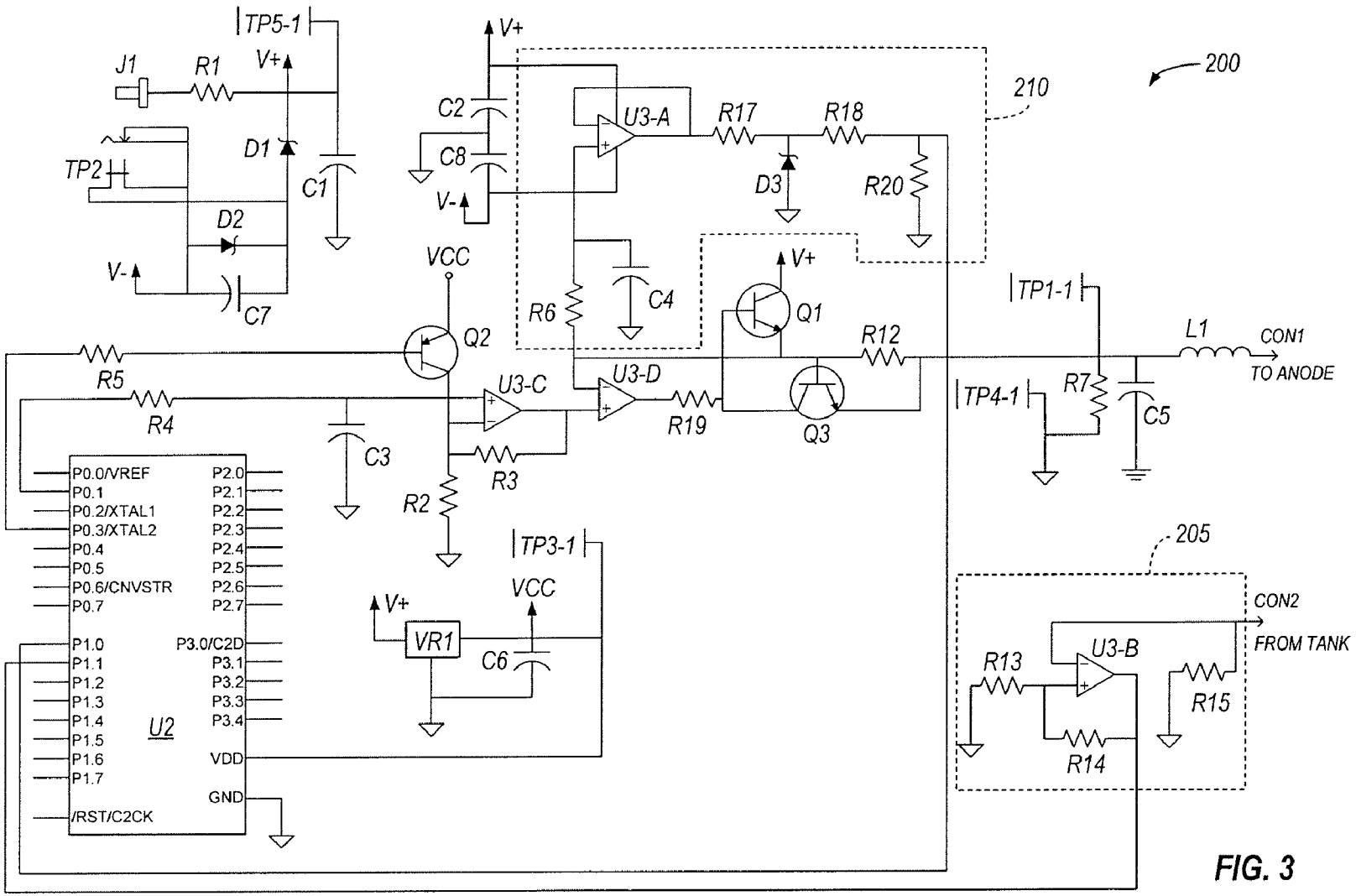
FIG. 3 is a electric schematic of a control circuit capable of controlling the electrode of FIG. 2.

An electronic schematic for one construction of the control circuit 200 used for controlling the electrode assembly 145 is shown in FIG. 3. The control circuit includes a microcontroller U2. An example microcontroller U2 used in one construction of the control circuit 200 is a Silicon Laboratories microcontroller, model no. 8051F310. As will be discussed in more detail below, the microcontroller U2 receives signals or inputs from a plurality of sensors, analyzes the inputs, and generates outputs to control the electrode assembly 145. In addition, the microcontroller U2 can receive other inputs (e.g., inputs from a user) and can generate outputs to control other devices (e.g., the heating element 140). As is known in the art, the Silicon Laboratories microcontroller, model no. 8051F310, includes a processor and memory. The memory includes one or more modules having instructions. The processor obtains, interprets, and executes the instructions to control the water heater 100, including the electrode assembly 145. Although the microcontroller U2 is described having a processor and memory, the invention may be implemented with other devices including a variety of integrated circuits (e.g., an application-specific-integrated circuit) and discrete devices, as would be apparent to one of ordinary skill in the art.

The microcontroller U2 outputs a pulse-width-modulated (PWM) signal at P0.1. Generally speaking, the PWM signal controls the voltage applied to the electrode wire 150. A one hundred percent duty cycle results in full voltage being applied to the electrode wire 150, a zero percent duty cycle results in no voltage being applied to the electrode wire 150, and a ratio between zero and one hundred percent will result in a corresponding ratio between no and full voltage being applied to the electrode wire 150.

The PWM signal is applied to a low-pass filter and amplifier, which consists of resistors R2, R3, and R4; capacitor C3; and operational amplifier U3-C. The low-pass filter converts the PWM signal into an analog voltage proportional to the PWM signal. The analog voltage is provided to a buffer and current limiter, consisting of operational amplifier U3-D, resistors R12 and R19, and transistors Q1 and Q3. The buffer and current limiter provides a buffer between the microcontroller U2 and the electrode assembly 145 and limits the current applied to the electrode wire 150 to prevent hydrogen buildup. Resistor R7, inductor L1, and capacitor C5 act as a filter to prevent transients and oscillations. The result of the filter is a voltage that is applied to the electrode assembly 145, which is electrically connected to CON1.

As discussed later, the drive voltage is periodically removed from the electrode assembly 145. The microcontroller deactivates the drive voltage by controlling the signal applied to a driver, which consists of resistor R5 and transistor Q2. More specifically, pulling pin P0.3 of microcontroller U2 low results in the transistor Q1 turning OFF, which effectively removes the applied voltage from driving the electrode assembly 145. Accordingly, the microcontroller U2, the low-pass filter and amplifier, the buffer and current limiter, the filter, and the driver act as a variable voltage supply that controllably applies a voltage to the electrode assembly 145, resulting in the powered anode. Other circuit designs known to those skilled in the art can be used to controllably provide a voltage to the electrode assembly 145.

The connection CON2 provides a connection that allows for an electrode return current measurement. More specifically, resistor R15 provides a sense resistor that develops a signal having a relation to the current at the tank. Operational amplifier U3-B and resistors R13 and R14 provide an amplifier that provides an amplified signal to the microcontroller U2 at pin P1.1. Accordingly, resistor R15 and the amplifier form a current sensor 205. However, other current sensors can be used in place of the sensor just described.

With the removal of the voltage, the potential at the electrode 145 drops to a potential that is offset from, but proportional to, the open circuit or "natural potential" of the electrode 145 relative to the tank 105. A voltage proportional to the natural potential is applied to a filter consisting of resistor R6 and capacitor C4. The filtered signal is applied to operational amplifier U3-A, which acts as a voltage follower. The output of operational amplifier U3-A is applied to a voltage limiter (resistor R17 and zener diode D3) and a voltage divider (resistor R18 and R20). The output is a signal having a relation to the natural potential of the electrode assembly 145, which is applied to microcontroller U2 at pin P1.0. Accordingly, the just-described filter, voltage follower, voltage limiter, and voltage divider form a voltage sensor 210. However, other voltage sensors can be used in place of the disclosed voltage sensor.

The control circuit 200 controls the voltage applied to the electrode wire 150. As will be discussed below, the control circuit 200 also measures tank protection levels, adapts to changing water conductivity conditions, and adapts to electrode potential drift in high conductivity water. In addition, when the control circuit 200 for the electrode assembly 145 is combined or in communication with the control circuit for the heating element 140, the resulting control circuit can take advantage of the interaction to provide additional control of the water heater.

Figure 4:
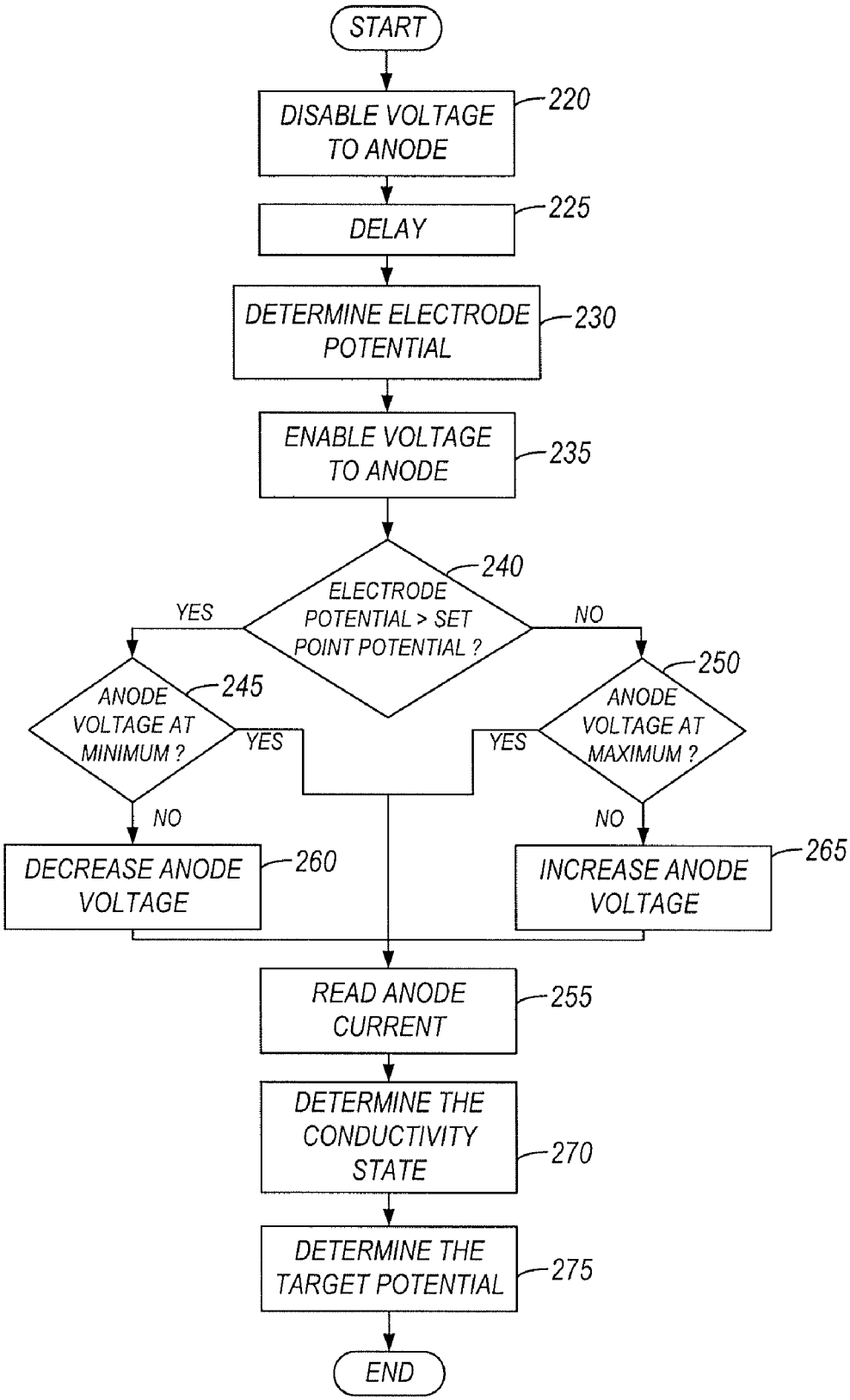
FIG. 4 is a flow chart of a subroutine capable of being executed by the control circuit shown in FIG. 3.

FIG. 4 provides one method of controlling the electrode assembly 145. Before proceeding to FIG. 4, it should be understood that the order of steps disclosed could vary. Furthermore, additional steps can be added to the control sequence and not all of the steps may be required. During normal operation, voltage is applied from the control circuit 200 to the electrode assembly 145. Periodically (e.g., every 100 ms), an interrupt occurs and the control circuit enters the control loop shown in FIG. 4.

With reference to FIG. 4, the control circuit 200 disables the voltage applied to the electrode assembly 145 (block 220). After disabling the voltage, the control circuit 200 performs a delay (block 225), such as 250 μs, and determines an electrode potential (block 230). The control circuit 200 performs the delay to allow the electrode assembly 145 to relax to its open circuit. The microcontroller U1 then acquires this potential from the voltage sensor 210. The control circuit 200 then reapplies the voltage to the electrode assembly 145 (block 240). At block 240, the control circuit 200 determines whether the electrode potential is greater than a target potential. If the electrode potential is greater than the target potential, the control circuit proceeds to block 245; otherwise the control proceeds to block 250.

At block 245, the control circuit 200 determines whether the applied voltage is at a minimum value. If the applied voltage is at the minimum, the control circuit 200 proceeds to block 255; otherwise the control circuit 200 proceeds to block 260. At block 260, the control circuit decreases the applied voltage.

At block 250, the control circuit 200 determines whether the applied voltage is at a maximum value. If the applied voltage is at the maximum, the control circuit 200 proceeds to block 255; otherwise the control circuit proceeds to block 265. At block 265, the control circuit 200 increases the applied voltage. By decreasing or increasing the applied voltage at block 260 or 265, respectively, the control circuit 200 can indirectly adjust the electrode potential. Increasing the applied voltage will result in an increase in the tank potential measured by the electrode and decreasing the applied voltage will decrease the tank potential measured by the electrode. Therefore, the control circuit 200 can adjust the open circuit potential of the electrode until it reaches the target potential. Furthermore, as the characteristics of the water heater 100 change, the control circuit 200 can adjust the voltage applied to the electrode to have the open circuit potential of the electrode equal the target point potential.

At block 255, the control circuit acquires an electrode current. More specifically, the microcontroller U1 receives a signal that represents a sensed current from the current sensor 205. At block 270, the control circuit determines a conductivity state of the water. For example, the conductivity state can be either a high conductivity for the water or a low conductivity for the water. To determine the conductivity state (either high or low), the microcontroller U1 divides the applied current by an incremental voltage, which is equal to the applied voltage minus the open circuit potential. If the resultant is less than an empirically set value, then the control circuit 200 determines the conductivity state is low and sets the target potential to a first value; otherwise the control circuit sets the target potential to a second value indicating a high conductivity state (block 275). The control circuit 200 can repeatedly perform the conductivity test during each interrupt (as shown in FIG. 4), periodically perform the conductivity test at a greater interval than the setting of the electrode voltage, or perform the conductivity test only during a startup sequence. Additionally, while only two set points are shown, it is envisioned that multiple set points can be used. It is also envisioned that other methods can be used to determine the conductivity state of the water. For example, a ratio of the applied current divided by the applied voltage can be used to determine the conductivity state.

In addition to establishing a set point, the control circuit 200 can use the acquired current to determine whether the water heater 100 is in a dry-fire state. The term "dry fire" refers to the activation of a water heater that is not storing a proper amount of water. Activation of a heating element (e.g., an electric resistance heating element or a gas burner) of a water heater in a dry-fire state may result in damage to the water heater. For example, if water is not properly surrounding the electric resistance heating element 140, then the electric resistance heating element may burnout in less than a minute when voltage is applied to the heating element 140. Therefore, it is beneficial to reduce the likelihood of activating the heating element 140 if the water heater 100 is in a dry-fire state. If the acquired current is less than a minimum value (e.g., essentially zero), then it is assumed that the water heater 100 is not storing the proper amount of water and the control circuit 200 prevents the activation of the heating element 140. It is also envisioned that other methods for determining a dry-fire state can be used. For example, the control circuit 200 can be designed in such a fashion that the electrode potential will be approximately equal to the applied voltage under dry fire conditions.

Thus, the invention provides, among other things, a new and useful water heater and method of controlling a water heater. Various features and advantages of the invention are set forth in the following claims.

What is claimed is:

1. A method of controlling the operation of a water heater, the water heater comprising a tank, a heating element, an electrode, and a sensor configured to detect an electrical characteristic of a circuit formed by the tank, the electrode, and water in the tank, the method comprising:

applying a voltage to the electrode;

acquiring a signal from the sensor, the signal having a relation to the applied voltage;

determining whether the water heater is in a dry-fire state based on the acquired signal;

limiting activation of the heating element when the water heater is in a dry-fire state;

determining a conductivity of a fluid in the tank based on the signal when the water heater is not in a dry-fire state;

wherein the sensor includes a voltage sensor;

wherein the acquiring a signal from the sensor comprises sensing a potential of the electrode relative to the tank;

wherein the method further comprises ceasing application of the applied voltage;

wherein the sensing a potential occurs after the ceasing application of the applied voltage; and wherein the determining whether the water heater is in a dry-fire state includes determining whether the sensed potential is less than a threshold, the threshold indicating a dry-fire state.

2. The method of claim 1, wherein the sensor includes a current sensor, and wherein the acquiring a signal from the sensor comprises sensing a current applied to the tank.

3. The method of claim 2, wherein the sensing a current occurs when the voltage is applied to the electrode.

4. The method of claim 1, wherein the determining whether the water heater is in a dry-fire state includes determining whether the signal is less than a threshold, the threshold indicating the dry-fire state.

5. The method of claim 1, wherein the sensor is electrically connected to at least one of the electrode and the tank.

6. The method of claim 1, further comprising protecting the tank from corrosion by applying the voltage to the electrode.

7. A method of preventing activation of a heating element when a dry-fire condition exists in a water heater having a tank, a heating element positioned in the tank, a powered electrode positioned in the tank, and a controller, the method comprising:

applying an analog voltage to the powered electrode;

detecting a current having a relation to the analog voltage;

determining if the detected current is below a threshold;

isolating the heating element from a power source when the detected current is below the threshold; and removing the analog voltage from the powered electrode and determining a conductivity of a system, including water in the tank, based on the detected current when the detected current is above a threshold and when the analog voltage is removed from the powered electrode.

8. The method of claim 7, further comprising suspending the determining the conductivity of the system if the detected current is below a threshold when the analog voltage is removed from the powered electrode.

9. The method of claim 7, further comprising generating a pulse width modulated signal and converting the pulse width modulated signal into the analog voltage.

10. The method of claim 9, further comprising adjusting a duty cycle of the pulse width modulated signal based on a conductivity of a system including the tank and water in the tank.

* * * * *